US006812633B2

(12) United States Patent
Kim et al.

(10) Patent No.: US 6,812,633 B2
(45) Date of Patent: Nov. 2, 2004

(54) PANEL FOR USE IN A CATHODE RAY TUBE

(75) Inventors: Suck Young Kim, Suwon-si (KR); Kyoung Mun Choo, Suwon-si (KR)

(73) Assignee: Samsung Corning Co., Ltd. (KR)

( * ) Notice: Subject to any disclaimer, the term of this patent is extended or adjusted under 35 U.S.C. 154(b) by 0 days.

(21) Appl. No.: 10/439,908

(22) Filed: May 16, 2003

(65) Prior Publication Data

US 2004/0051439 A1 Mar. 18, 2004

(30) Foreign Application Priority Data

May 17, 2002 (KR) ..... 10-2002-0027279

(51) Int. Cl.[7] ..... H01J 31/00
(52) U.S. Cl. ..... 313/477 R; 313/461
(58) Field of Search ..... 313/461, 477 R; 220/2.1 A

(56) References Cited

U.S. PATENT DOCUMENTS 4,537,322 A * 8/1985 Okada et al. ..... 220/2.1 A

* cited by examiner

*Primary Examiner*—Vip Patel
(74) *Attorney, Agent, or Firm*—Anderson Kill & Olick, PC

(57) ABSTRACT

A panel for use in a cathode ray tube of the present invention includes a face portion, a skirt portion extending from a periphery of the face portion and a blend round portion connecting the face portion and the skirt portion. A mold match line is formed on the skirt portion in a manner that a mold match line height H1 satisfies a first equation: $0<H1 \leqq H \times 0.47$ when mean outer radius of curvature is equal to greater than 10,000 mm, and satisfies a second equation: $0<H1 \leqq H \times 0.37$ when mean outer radius of curvature is less than 10,000 mm, where H is an overall height of the panel.

2 Claims, 5 Drawing Sheets

PANEL FOR USE IN A CATHODE RAY TUBE

FIELD OF THE INVENTION

The present invention relates to a cathode ray tube; and more particularly, to a cathode ray tube capable of effectively preventing the failure thereof by way of optimizing the location of a mold match line.

BACKGROUND OF THE INVENTION

As well known, a glass bulb in a cathode ray tube (CRT) used in a TV set or a computer monitor basically includes a panel for displaying picture images, a conical funnel sealed to the back of the panel and a cylindrical neck integrally connected to an apex portion of the conical funnel. The panel, the funnel and the neck are made of glass, wherein particularly the panel and the funnel are formed of predetermined dimensions and shapes by press forming a glass gob.

Referring to FIG. 1, there is illustrated a cross sectional view of a conventional glass bulb 10. A panel 20 of the glass bulb 10 is provided with a face portion 21 whose inner surface is covered with an array of dots of fluorescent material (not shown) to display picture images; a skirt portion 23 extending backward from a perimeter of the face portion 21 and having a seal edge 22 on its back edge; and a blend round portion (or corner portion) 24 integrally joining the face portion 21 to the skirt portion 23. A funnel 30 of the glass bulb 10 can be divided into a body portion 32, i.e., a fore part thereof, having a seal edge 31 connected to the seal edge 22 of the skirt portion 23; and a yoke portion 33, i.e., a back part thereof, extending backward from the body portion 32. And a neck 40 of the glass bulb 10 is connected to the yoke portion 33 of the funnel 30. A tube axis 11 passes through the center of the face portion 21 and coincides with an axis of the neck 40. Placed by way of the so-called "shrinkage fit" scheme around the outer periphery of the skirt portion 23 is a metallic implosion-proof band 50, which strengthens the bulb 10 against tensile stress induced in the blend round portion 24 and the skirt portion 23 by evacuating the inner space of the bulb 10, so that fragments of the glass can be prevented from flying away when the panel 20 is broken or exploded.

Referring to FIG. 2, there is illustrated a schematic cross-sectional view of a mold set 60 for forming the panel 20. The mold set 60 is provided with a bottom mold 62 in which a cavity 61 is formed; a middle mold (or shell) 63, for forming the skirt portion 23 and the seal edge 22, which is fitted on top of the bottom mold 62; and an upper mold 64 (or plunger) which presses a glass gob loaded in the cavity 61 of the bottom mold 62 to form the panel 20. The upper mold 64 is connected to a press ram 65, so that it can be lifted or lowered by the ram 65 so as to press the glass gob loaded in the cavity 61 of the bottom mold 62 to form the panel 20. There exists a parting line 66 between the bottom mold 62 and the middle mold 63. Therefore, when the panel 20 is formed in the mold set 60 as shown in FIG. 1, a mold match line 25, which is a flash made by the parting line 66, is formed on the outer periphery of the skirt portion 23 near the face portion 21. The peripheral length of the mold match line 25 represents the maximum peripheral length of the panel 20. And, in general, the position of the parting line 66 and thus the position of the mold match line 25 are set near the face portion 21 rather than the seal edge 22 in order to ease the extraction of the molded panel 20 from the bottom mold 62.

Referring to FIG. 3, there is illustrated a schematic cross sectional view of the panel 20 of FIG. 1. Formed on the outer periphery of the skirt portion 23 is a first tapered surface 26, which extends from the mold match line 25 toward the seal edge 22 with an inward slant of a first slant angle θ1 with respect to the tube axis 11. And the first slant angle θ1 is set less than 1.5° in order to prevent the band 50 from slipping. There is formed a second tapered surface 27 between the first tapered surface 26 and the seal edge 22. The second tapered surface 27 has a second slant angle θ2 ranging from, e.g., 3° to 4°. The border where the first tapered surface 26 meets with the second tapered surface 27 is referred to as a break line 28, which is positioned away from a lower end of the implosion-proof band 50.

When the explosion-proof band 50 is installed around the outer periphery of the skirt portion 23 of the glass bulb 10 after the glass bulb being evacuated, the implosion-proof band 50 expanded by heating is pushed from the side of the face portion 21, and then is fitted around the skirt portion 23. At this time, the mold match line 25 is brought into contact with the implosion-proof band 50, which may incur scratches or/and cracks in the mold match line 25. Therefore, in a case where the mold match line 25 is formed near the face portion 23, an area of the inner surface of the implosion-band 50 sweeping or scrubbing the mold match line 25 is comparatively greater and thus, the frequency of the contacts between the mold match line 25 and the implosion-proof band 50 increases. Consequently, a greater number of cracks and scratches are formed in the mold match line 25. Further, additional cracks are developed in the mold match line 25 by a compressive stress generated by the shrinkage of the expanded implosion-proof band 50.

Such cracks formed in the mold match line 25 of the skirt portion 23 are one of the major causes for rendering the breakage or failure of the cathode ray tube occurring when the cathode ray tube is subject to a heat treatment in an annealing lehr for removing remaining stress therefrom, resulting in an increase of the production cost and the deterioration of production yield.

SUMMARY OF THE INVENTION

It is, therefore, an object of the present invention to provide a panel for use in a cathode ray tube (CRT) capable of effectively preventing the failure of the CRT, such as implosion or breakage, during a heat treatment process of the CRT by optimizing the location of the mold match line.

It has been found by the inventors of the present invention that the cracks and scratches can be effectively prevented from forming in the mold match line by locating the mold match line such that the inner surface area of the implosion-proof band sweeping the mold match line is comparatively less and the mold match line is subject to the comparatively less compressive force produced by the implosion-proof band.

In accordance with a preferred embodiment of the present invention, there is provided a panel for use in a cathode ray tube, including: a face portion for displaying picture images, whose mean outer radius of curvature is equal to or greater than 10,000 mm; a skirt portion extending from a periphery of the face portion and having a seal edge sealed to a funnel; and a blend round portion connecting the face portion and the skirt portion, wherein a mold match line is formed on the skirt portion in a manner that a mold match line height H1 satisfies a following equation: $0<H1\leqq H\times 0.47$ where an overall height H is a distance between a first plane passing through the seal edge and a second plane passing through a center of the face portion, and the mold match line height H1 is a distance between the first plane and a third plane passing through the mold match line.

In accordance with another preferred embodiment of the present invention, there is provided a panel for use in a cathode ray tube, including: a face portion for displaying picture images, whose mean outer radius of curvature is less than 10,000 mm; a skirt portion extending from a periphery of the face portion and having a seal edge sealed to a funnel; and a blend round portion connecting the face portion and the skirt portion, wherein a mold match line is formed on the skirt portion in a manner that a mold match line height H1 satisfies a following equation: $0<H1\leqq H\times 0.37$ where an overall height H is a distance between a first plane passing through the seal edge and a second plane passing through a center of the face portion, and the mold match line height H1 is a distance between the first plane and a third plane passing through the mold match line.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
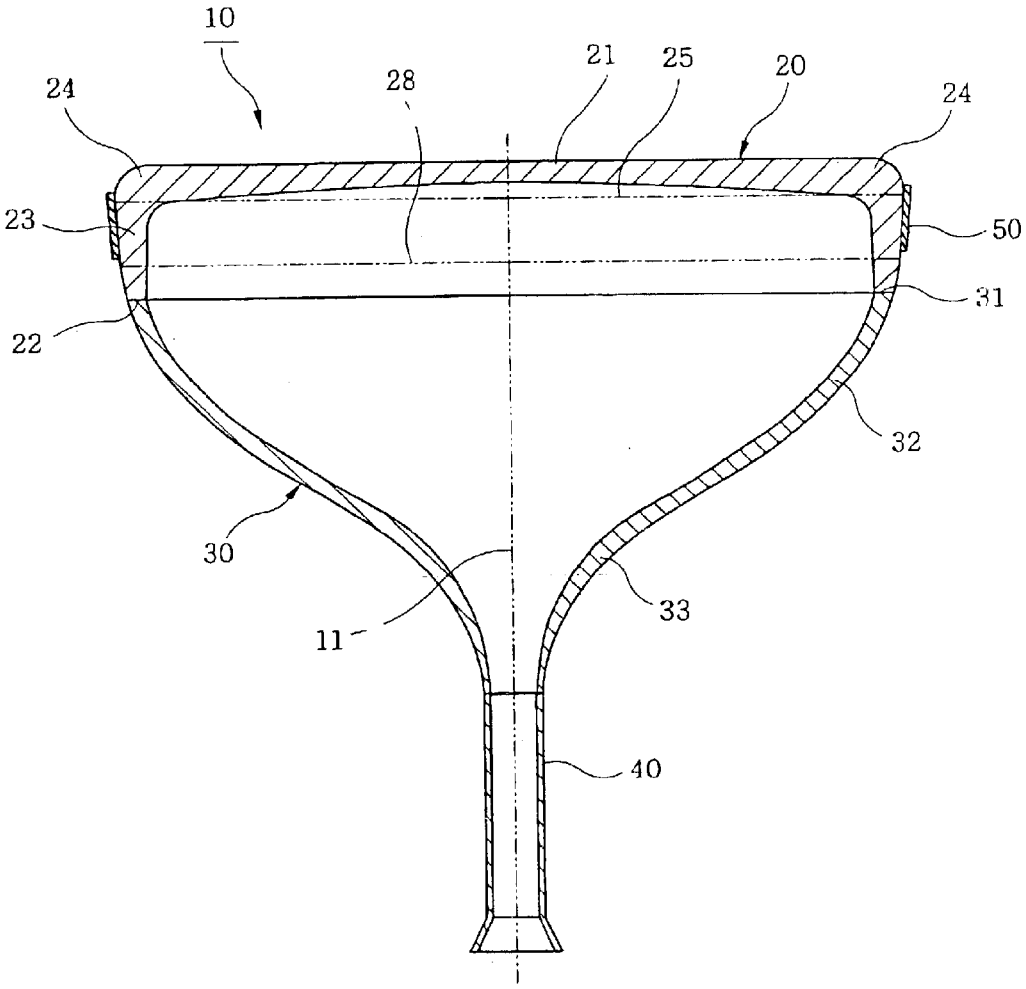
FIG. 1 (PRIOR ART)
FIG. 1 illustrates a cross sectional view of a conventional glass bulb.
Figure 2:
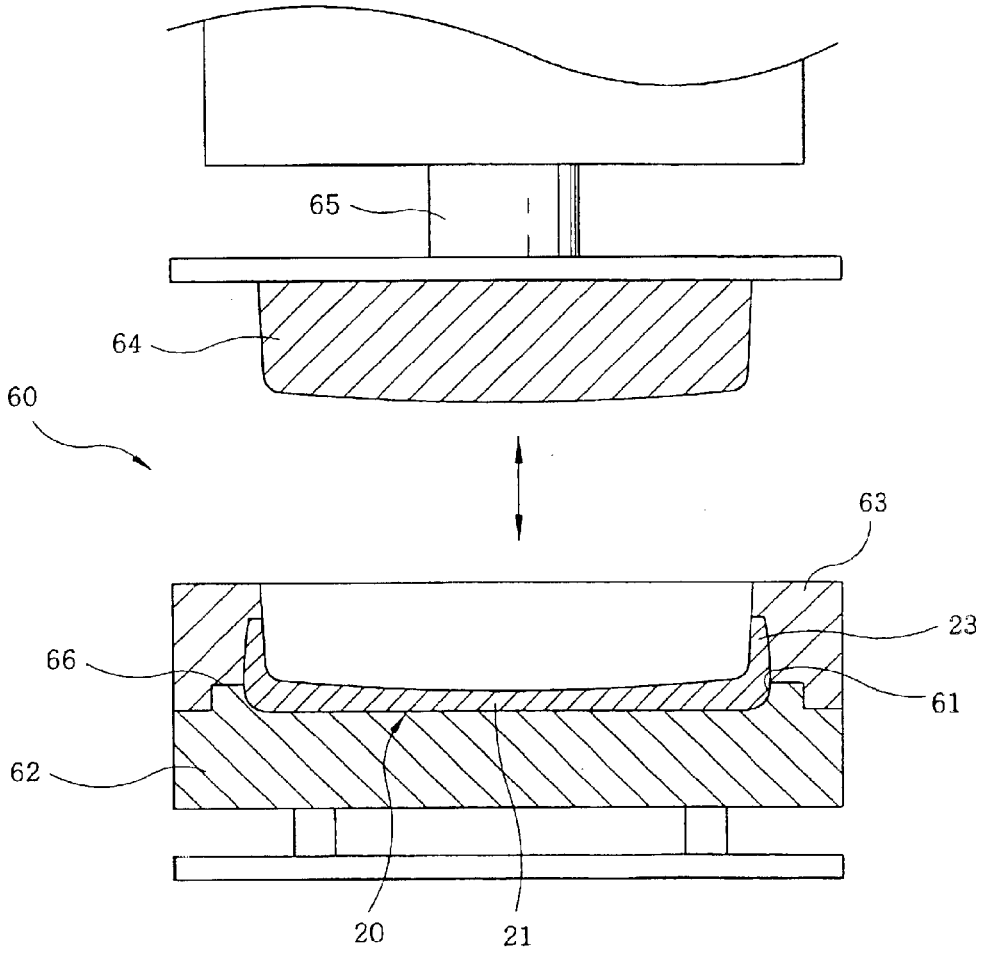
FIG. 2 presents a schematic cross-sectional view of a mold set for forming a panel.
Figure 3:
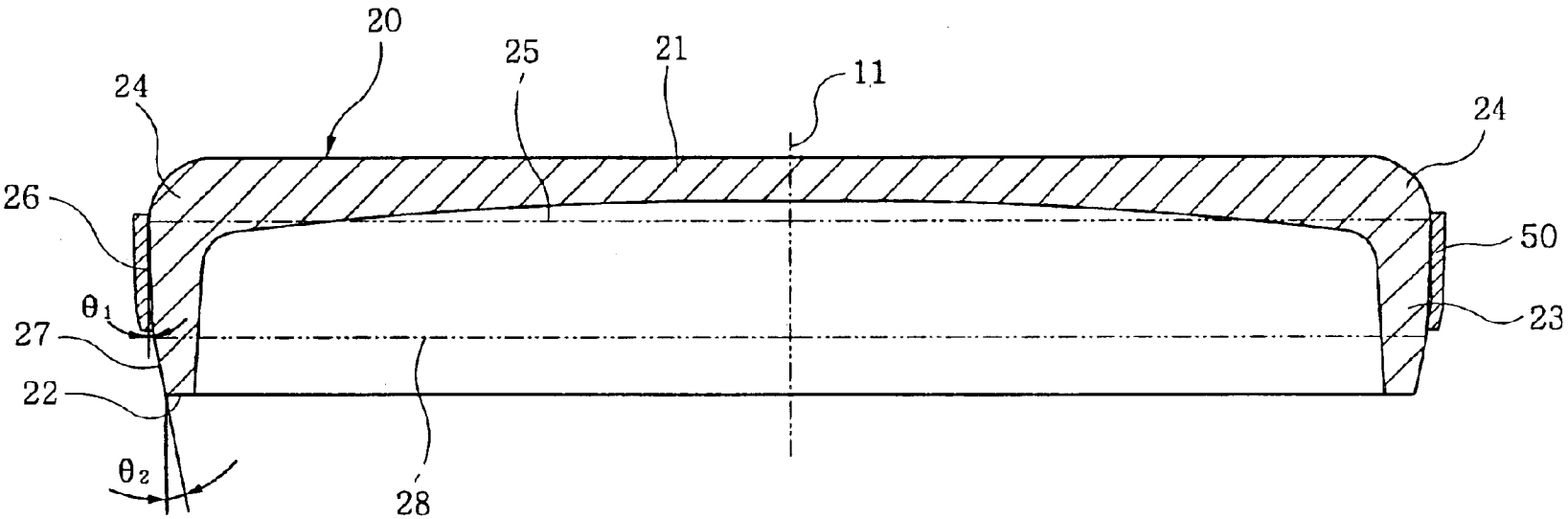
FIG. 3 (PRIOR ART)
FIG. 3 depicts a schematic cross sectional view of a panel of FIG. 1.

Panels for use in a cathode ray tube in accordance with preferred embodiments of the present invention will now be described with reference to accompanying drawings. And like parts will be represented with like reference numerals.

Figure 4:
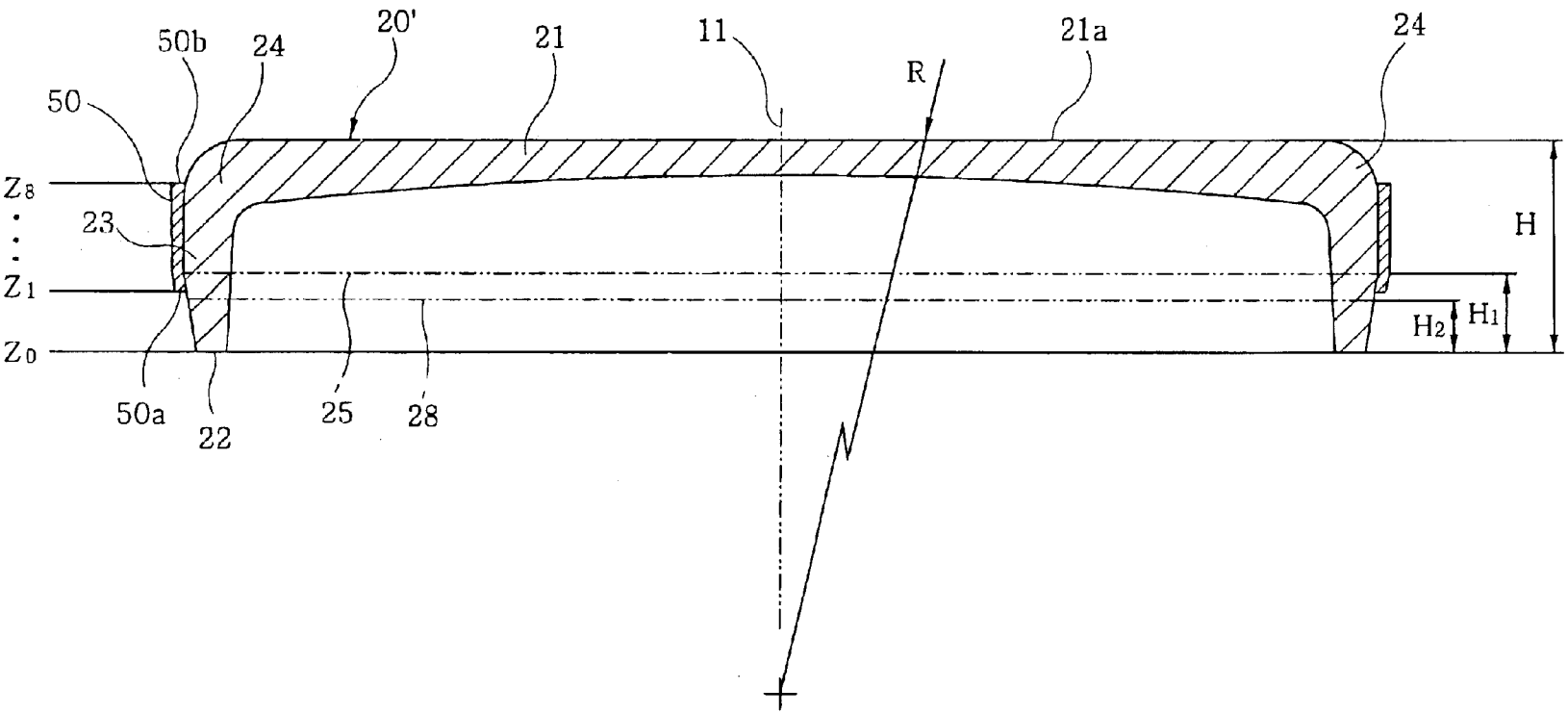
FIG. 4 offers a schematic cross sectional view of a flat panel in accordance with preferred embodiments of the present invention.
Figure 5:
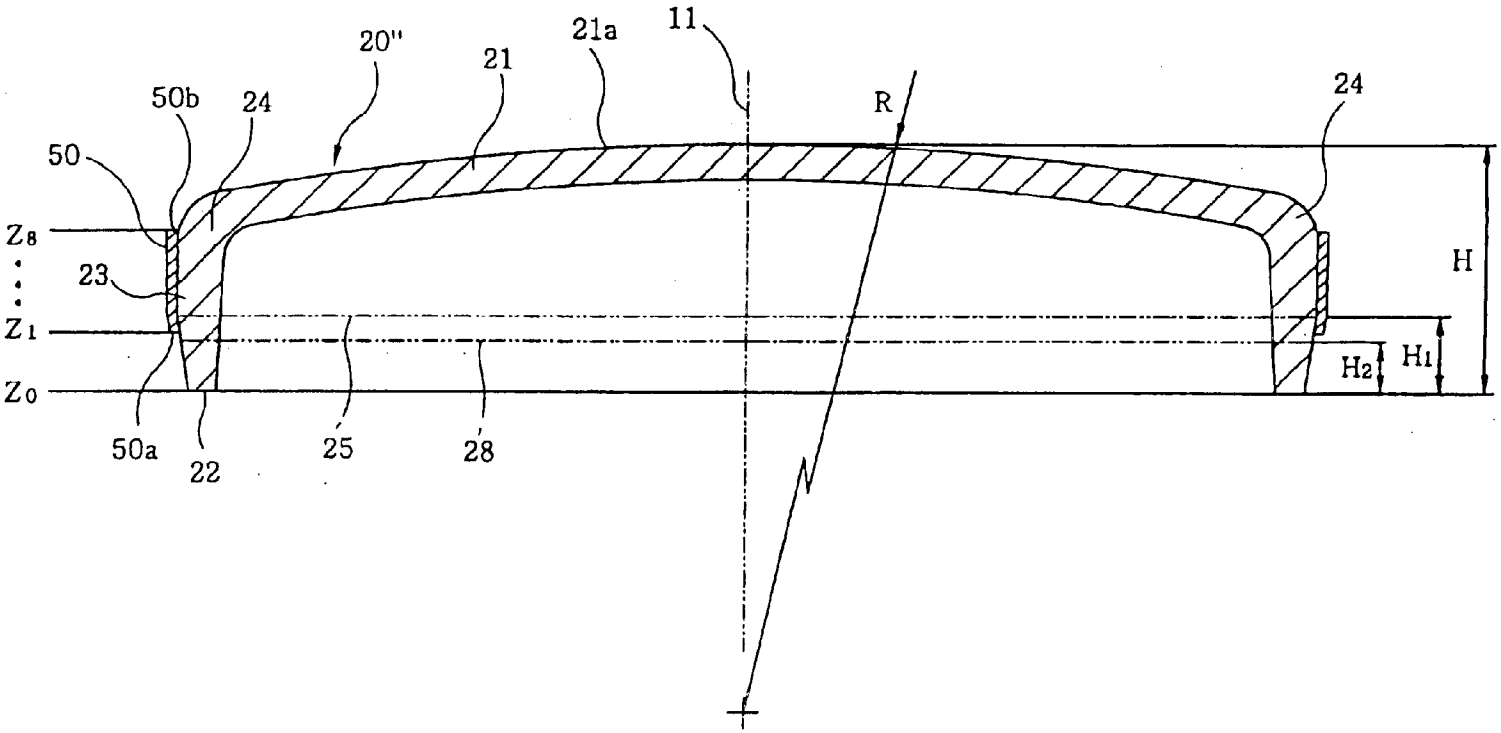
FIG. 5 sets forth a schematic cross sectional view of a spherical panel (or regular type panel) in accordance with preferred embodiments of the present invention.

Referring to FIGS. 4 and 5, there are illustrated schematic cross sectional views of a flat panel 20' and a spherical panel (or regular type panel) 20" in accordance with preferred embodiments of the present invention, respectively. These panels are classified into the flat panel 20' and the spherical panel 20" on the basis of their mean outer radius of curvature R, which is an average of radii of curvature of an outside contour 21*a* passing through a center of a face portion 21 in predetermined radial directions. In addition, the center of the face portion 21 is a point where an axis of a neck 40 (shown in FIG. 1) passes through and is an intersection of the diagonals of the face portion 21. The reference notation H represents an overall height of the panel 20' or 20", i.e., a distance between a first imaginary plane passing through a seal edge 22 and a second imaginary plane passing through the center of the face portion 21 on the outer contour 21*a* and being parallel to the first plane; H1, a height of a mold match line 25, i.e., a distance between the first plane and a third imaginary plane passing through the mold match line 25 whose outer peripheral length represents a maximum length of the panel 20' and 20"; and H2, a height of a break line 28, i.e., a distance between the first plane and a fourth imaginary plane passing through the break line 28.

In general, the mean outer radius of curvature R of the flat panel 20' is equal to or greater than 10,000 mm, and the mean outer radius of curvature R of the spherical panel 20" is less than 10,000 mm. And it is widely known that the flat panel 20' is more advantageous than the spherical panel 20" in that it causes less image distortion and less eye fatigue, and has wide range of visibility.

The flat panel 20' shown in FIG. 4 satisfies a design guideline, such as the outer radius of the curvature R being equal to or greater than 10,000 mm and the mold match line height H1 satisfying the following equation:

$$0<H1\leqq H\times 0.47 \qquad \text{Eq. 1}$$

In other words, the mold match line 25 is formed at or below a position whose height from the seal edge 22 is 47% of the overall height H.

Experiment 1

In Tables 1 and 2, band tensions measured at predetermined points of implosion-proof bands along its widthwise (or axial) direction are listed, wherein the implosion-proof bands were placed around glass panels for televisions of 29 and 32-inch models, respectively, each having a useful screen area of an aspect ratio of 4:3.

As shown in FIG. 4, Tables 1 and 2, a band zone Z0 represents a reference height, i.e., the seal edge 22; a band zone Z1, the height of the lower edge of the implosion-proof band 50 near the seal edge 22; and a band zone Z8, the height of the upper edge of the explosion-proof band 50 near the face portion 21. In addition, band zones Z2 to Z7 correspond to points arranged in the implosion-proof band 50 along the width thereof with predetermined distances therebetween. In Tables 1 and 2, ratios (%) represent percentages of the mold match line height H1, the break line height H2 and heights of the band zones Z1 to Z8 to the overall height H of the panel 20, respectively, wherein the heights of the band zones Z1 to Z8 are distances between the first plane and planes passing through the band zones Z1 to Z8 and being parallel with the first plane, respectively, and other height hereinafter will also be measured likewise.

TABLE 1

| Flat Panel for 29-inch model | Height (mm) | Ratio (%) | Band Tension (Mpa) |
|---|---|---|---|
| H | 97.6 | 100 | — |
| H1 | 69.6 | 71 | — |
| H2 | 31.6 | 32 | — |
| Band Zones | | | |
| Z1 | 33.1 | 34 | 48.4 |
| Z2 | 45.0 | 46 | 91.8 |
| Z3 | 47.0 | 48 | 167.1 |
| Z4 | 56.1 | 57 | 129.8 |
| Z5 | 63.8 | 65 | 111.9 |
| Z6 | 69.8 | 72 | 207.9 |
| Z7 | 78.3 | 80 | 218.1 |
| Z8 | 86.9 | 89 | 132.3 |

As indicated in Table 1, a lower edge of the implosion-proof band was positioned 33.1 mm high from the seal edge and 1.5 mm high from break line. Further, the upper edge of the implosion-proof band was positioned 86.9 mm high from the seal edge and 17.3 mm high from the mold match line.

The band tension at Z3 of 167.1 MPa was dropped sharply to the band tension at Z2 of 91.8 MPa, and the difference therebetween was as large as 75.3 MPa. From this and Table 1, it can be inferred that the band tension declines as the height from the seal edge is lowered below the band zone Z2 whose ratio (%) of the height to the overall height H is 46% and hence, satisfies Eq. 1. Moreover, the height of a middle point between the band zones Z2 and Z3, whose ratio of the height to the overall height H is 47%, satisfies Eq. 1. Accordingly, by forming the mold match line below the middle point, the mold match line will be subject to a comparatively less compressive force as a result of the band tension, and hence a comparatively less number of cracks will be formed therein. Consequently, breakage of glass bulbs made of panels whose mold match lines are formed below the middle point is reduced.

Further, although skirt portion's configuration of panels whose match mold line is formed at or below the middle point is different from that of the panel used in this Experiment 1, the difference can be neglected since the first slant angle θ1 is small and therefore, the distribution of the band tension of the implosion-proof band used in such panels is similar to that of the panel used in this Experiment 1.

The heights of the band zones Z3 to Z8 do not satisfy Eq. 1. And if the mold match line is formed at one position between the band zones Z3 and Z8, it will be subject to a greater compressive force as a result of the greater band tension, thereby having a higher potential to be scratched and/or crack during and after the installation of the implosion-proof band. Consequently, the glass bulb made of such panel also will have a higher potential to be broken.

TABLE 2

| Flat panel for 32-inch model | height (mm) | ratio (%) | band tension (Mpa) |
|---|---|---|---|
| H | 113.0 | 100 | — |
| H1 | 82.5 | 73 | — |
| H2 | 33.0 | 29 | — |
| Band Zones | | | |
| Z1 | 34.5 | 31 | 94.7 |
| Z2 | 49.0 | 43 | 72.9 |
| Z3 | 54.1 | 48 | 218.8 |
| Z4 | 60.9 | 54 | 132.0 |
| Z5 | 69.7 | 62 | 115.7 |
| Z6 | 82.8 | 73 | 309.6 |
| Z7 | 91.3 | 81 | 231.0 |
| Z8 | 99.8 | 88 | 100.0 |

As indicated in Table 2, a lower edge of the implosion-proof band surrounding a flat panel for 32-inch model was positioned 34.5 mm high from the seal edge and the upper end thereof was positioned 99.8 mm high from the seal edge. The band tension at the band zone 3 of 218.8 MPa was dropped sharply to the band tension at the band zone 2 of 72.9 MPa, and the difference therebetween was as large as 145.9 MPa. From this and Table 2, it can be inferred that band tension declines as a measuring height is lowered below the band zone Z2 whose ratio of the height to the overall height H is 43% and hence, satisfies Eq. 1. Accordingly, by forming the mold match line below the middle point, the mold match line will be subject to a comparatively less compressive force as a result of the band tension, and hence a comparatively less number of cracks will be formed therein. Consequently, breakage of glass bulbs made of panels whose mold match lines are formed below the middle point will be reduced.

The band zones Z3 to Z8 do not satisfy Eq. 1. And if the mold match line is formed at one position between the band zones Z3 and Z8, it will be subject to a greater compressive force as a result of the greater band tension and therefore, comparatively more scratches and/or cracks will be formed therein during and after the installation of the implosion-proof band. Consequently, the glass bulb made of a panel whose mold match line is formed between the band zones Z3 and Z8 also will have a higher potential to be broken.

Further, in Tables 1 and 2, although band stress of the band zone 8 was close to that of the position whose ratio (%) was 47%, it was so near to the face portion that the mold match line could not be formed thereon. And although band stresses of the band zones Z4 and Z5 were also close to that of the position whose ratio was 47%, more cracks and/or scratches were formed during the implosion-proof band installation since the face portion was first entered into the implosion-proof band. In other words, the area of the implosion-proof band sweeping or scrubbing the mold match line was comparatively greater and thus the frequency of contacts between the mold match line and the inner surface of the implosion-proof band.

The spherical panel 20" shown in FIG. 5 satisfies design guideline, such as outer radius of curvature R being less than 10,000 mm and the height of the mold match line H1 satisfying the following Eq. 2:

$$0<H1\leqq H\times 0.37 \qquad \text{Eq. 2}$$

In other words, the mold match line is formed on the spherical panel in a manner that the ratio of the mold match line height H1 to the overall height H is equal to or less than 37%.

Experiment 2

Two spherical glass panels for televisions of 28 and 29-inch models, each having a useful screen area of an aspect ratio of 4:3, were prepared. Then, explosion-proof bands were placed around the outer periphery of the skirt portions thereof. Afterwards, band tensions were measured at band zones Z1 to Z8 and listed in Tables 3 and 4. The ratios and heights in Tables 3 and 4 were defined with a same method as in Experiment 1, and therefore, the explanation therefor will be omitted for simplicity.

TABLE 3

| Spherical Panel for 32-inch model | Height (mm) | Ratio (%) | Band Tension (Mpa) |
|---|---|---|---|
| H | 99.6 | 100 | — |
| H1 | 53.1 | 53 | — |
| H2 | 25.1 | 25 | — |
| Band Zones | | | |
| Z1 | 15.0 | 15 | 110.5 |
| Z2 | 36.8 | 37 | 150.2 |
| Z3 | 40.0 | 40 | 364.5 |
| Z4 | 44.5 | 45 | 394.1 |
| Z5 | 48.5 | 49 | 387.3 |
| Z6 | 51.0 | 51 | 336.3 |
| Z7 | 55.0 | 55 | 250.0 |
| Z8 | 60.0 | 60 | 157.6 |

As indicated in Table 3, a lower edge of the explosion-proof band placed around the glass panel for TV of 28-inch model was positioned 15 mm high from the seal edge and an upper edge of the explosion-proof band was positioned 60 mm high from the seal edge. The band tension at the band zone 3 of 364.5 MPa was dropped to the band tension at the band zone 2 of 150.2, and the difference therebetween was as large as 214.3 MPa. From this and Table 3, it can be inferred that band tension declines phenomenally below the band zone Z2 whose the ratio of the height to the overall height H is 37%, thereby satisfying Eq. 2.

Accordingly, by forming the mold match line below the band zone Z2, the mold match line will be subject to a less compressive force as a result of the less band tension, hence comparatively less number of cracks will be formed therein. Consequently, breakage of the bulb made of a panel whose mold match line is formed below the middle point can be reduced.

The band zones Z3 to Z8 do not satisfy Eq. 2. And if the mold match line is formed at one position between the band zones Z3 and Z8, it will be subject to a comparatively greater compressive force as a result of the comparatively greater band tension and therefore, more cracks and scratches will be formed therein during and after the installation of the implosion-proof band. Consequently, the glass bulb made of a panel whose mold match line is formed between the band zones Z3 and Z8 will have a higher potential to be broken.

Further, although the band tension of the band zone Z8 was close to that of the band zone Z2 whose ratio was 37%, the band zone Z8 was so near to the face portion that the mold match line was formed thereon.

TABLE 4

| Spherical Panel for 32-inch model | Height (mm) | Ratio (%) | Band Tension (Mpa) |
|---|---|---|---|
| H | 113.7 | 100 | — |
| H1 | 50.7 | 45 | — |
| H2 | 25.7 | 23 | — |
| Band Zones | | | |
| Z1 | 10.0 | 9 | 100.6 |
| Z2 | 20.0 | 18 | 125.5 |
| Z3 | 41.0 | 36 | 150.8 |
| Z4 | 43.0 | 38 | 322.9 |
| Z5 | 45.0 | 40 | 260.9 |
| Z6 | 48.7 | 43 | 214.8 |
| Z7 | 52.6 | 46 | 150.0 |
| Z8 | 55.3 | 49 | 110.0 |

As indicated in Table 4, a lower edge of the implosion-proof band surrounding the spherical glass panel for a TV of 32-inch model was positioned 10 mm high from the seal edge and an upper edge thereof was positioned 55.3 mm high from the seal edge. The band tension at the band zone 4 of 322.9 MPa was sharply dropped to the band tension at the band zone 3 of 150.8 MPa, and the difference therebetween was as large as 172.1 MPa. From this and Table 4, it can be inferred that band tension declines phenomenally as a measuring height is reduced below the band zone Z3 whose ratio of the height to the overall height H is 36%, thereby satisfying Eq. 2. Accordingly, by forming the mold match line at or below the band zone Z3, the mold match line will be subject to a comparatively less compressive force as a result of the comparatively less band tension, and hence comparatively less number of cracks will be formed therein. Consequently, breakage of the bulb made of a panel whose mold match line is formed below the band zone Z3 can be reduced.

The band zones Z4 to Z8 do not satisfy Eq. 2. And if the mold match line is formed at one position between the band zones Z4 and Z8, it will be subject to a comparatively greater compressive force as a result of the comparatively greater band tension and therefore, comparatively more cracks and scratches will be formed therein during and after the installation of the implosion-proof band. Consequently, the glass bulb made of a panel whose mold match line is formed between the band zones Z4 and Z8 also will have a higher potential to be broken.

Further, in Table 4, although the band stresses of the band zone Z7 and Z8 were close to that of the band zone Z3, the band zones Z7 and Z8 were so near to the face portion that the mold match line could not be formed therein.

As described above, if the mold match line is formed at a position near the seal edge where the band tension is comparatively less, the mold match line will be subject to the comparatively less compressive force and will not contact with the implosion-proof band as many times as the mold match line formed near the face portion during the implosion-proof band installation. Accordingly, the formation of scratches and cracks in the mold match line of the flat or spherical glass panels for a cathode ray tube in accordance with the preferred embodiments of the present invention can be effectively reduced, and therefore, the glass bulb made of the panel of the present invention will have a less potential to be broken in the annealing lehr or other process, resulting in an improvement in productivity thereof and reduction in the economic loss.

While the invention has been shown and described with respect to the preferred embodiments, it will be understood by those skilled in the art that various changes and modifications may be made without departing from the spirit and scope of the invention as defined in the following claims.

What is claimed is:

1. A panel for use in a cathode ray tube, comprising:

a face portion for displaying picture images, whose mean outer radius of curvature is equal to or greater than 10,000 mm;

a skirt portion extending from a periphery of the face portion and having a seal edge sealed to a funnel; and a blend round portion connecting the face portion and the skirt portion, wherein a mold match line is formed on the skirt portion in a manner that a mold match line height H1 satisfies a following equation:

$$0<H1\leqq H\times 0.47$$

where an overall height H is a distance between a first plane passing through the seal edge and a second plane passing through a center of the face portion, and the mold match line height H1 is a distance between the first plane and a third plane passing through the mold match line.

2. A panel for use in a cathode ray tube, comprising:

a face portion for displaying picture images, whose mean outer radius of curvature is less than 10,000 mm;

a skirt portion extending from a periphery of the face portion and having a seal edge sealed to a funnel; and a blend round portion connecting the face portion and the skirt portion, wherein a mold match line is formed on the skirt portion in a manner that a mold match line height H1 satisfies a following equation:

$$0<H1\leqq H\times 0.37$$

where an overall height H is a distance between a first plane passing through the seal edge and a second plane passing through a center of the face portion, and the mold match line height H1 is a distance between the first plane and a third plane passing through the mold match line.

* * * * *